United States Patent [19]

Durham

[11] Patent Number: 4,579,243

[45] Date of Patent: Apr. 1, 1986

[54] BALANCED SERVING TRAY WITH REMOVABLE TRASH RECEPTACLE

[76] Inventor: Douglas R. Durham, 1949 Lima St., Aurora, Colo. 80010

[21] Appl. No.: 623,721

[22] Filed: Jun. 22, 1984

[51] Int. Cl.[4] ..... B65H 19/00

[52] U.S. Cl. ..... 220/23.83; 206/567; 294/144; 229/DIG. 7

[58] Field of Search ..... 220/23.83, 23.86, 23.4, 220/4 R; 206/567; 229/DIG. 7; 294/26.5, 32, 143, 144, 146, 159, 160, 172

[56] References Cited

U.S. PATENT DOCUMENTS

| | | | |
|---|---|---|---|
| 796,234 | 8/1905 | Merriman | 294/172 X |
| 901,444 | 10/1908 | Hebestreit | 294/160 X |
| 2,466,636 | 4/1949 | Bruckner et al. | 229/DIG. 7 |
| 2,512,963 | 6/1950 | Deiker | 294/159 X |
| 3,164,257 | 1/1965 | Foy | 294/144 X |
| 3,811,560 | 5/1974 | Schilling et al. | 220/23.86 X |
| 4,488,654 | 12/1984 | Odsgard | 229/DIG. 7 |

*Primary Examiner*—Steven M. Pollard
*Attorney, Agent, or Firm*—Gregg I. Anderson

[57] ABSTRACT

A serving tray is disclosed including an upper tray interconnected by a box structure to a lower tray. The upper tray has a flat planar configuration and a bottom surface which is held by the server using the tray. The interconnecting structure extends downwardly to connect to the lower tray which has multiple compartments for storage. An access notch for napkins is provided in the lower tray as is a removable storage receptacle for waste items. The center of gravity of the entire device is below the point where the arm and hand of the server support the upper tray through openings in the interconnecting box structure.

3 Claims, 7 Drawing Figures

BALANCED SERVING TRAY WITH REMOVABLE TRASH RECEPTACLE

BACKGROUND OF THE INVENTION

1. Field of the Invention

The present invention relates to serving trays of the type used by cocktail waitresses to carry cocktail glasses in drinking establishments. More particularly, the present invention relates to serving trays of the type having multiple compartments for storage of additional items such as napkins, cigarettes, matches, change, swizzle sticks and similar items used by or dispensed by cocktail waitresses.

2. Description of the Prior Art

Cocktail waitresses in serving drinks have traditionally relied upon a flat planar serving tray of circular plan view. This prior art serving tray is supported and balanced by the hand of the waitress. There is no provision in this particular prior art tray for storage of items involved in waitressing. For example, these serving trays do not include any compartments or storage receptacles for change, cigarettes, matches, and napkins or a place where trash can be placed for easy removal at a later time. Waitresses resort to ashtrays on the serving tray and waist tied purses to carry change. Separate trips to pick up trash are required.

Prior art patents include S. Frederickson U.S. Pat. No. Des. 1,831,652, which shows a tray with a wall thickness, a hole for the arm of the server being provided in the wall. Several compartments for storage appear to exist on essentially the same plane as the surface on which cocktail glasses would be carried. Frederickson is not a balanced system. A tray similar to the Frederickson tray is seen in J. Rayn U.S. Pat. No. Des. 230,810. Again, storage compartments are shown in the same plane as the serving surface.

J. Swett U.S. Pat. No. Des. 194,325 shows a two-level serving tray with a T-shaped carrying handle. The cups or glasses are mounted on the lower tray while miscellaneous items can be stored on the upper and lower trays as well. Add on another two-level tray similar to Swett is seen in I. Merriman U.S. Pat. No. 796,234. Merriman shows a connecting portion between an upper and lower tray. The upper and lower shelves or trays of the Merriman patent are used to support dishes while the interior of the bottom drum carries knives, forks and small table articles.

A tray having various storage compartments for carrying food and the like is seen in D. Lear U.S. Pat. No. 226,526. A strap is placed over the shoulders of the user and a concave shaped portion allows the tray to fit generally around the waist of the server or waiter.

O. Hebestreit U.S. Pat. No. 901,444 shows another tray having provision for storage under a removable tray surface. E. G. DeFoe et al. U.S. Pat. No. 1,892,234 shows attachments to a service tray wherein extra items can be stored. A compartmentalized container and serving device is seen in R. Stigler, U.S. Pat. No. 2,553,880. Other serving trays which are compartmentalized are seen in N. McLeod, U.S. Pat. No. 2,948,391 and E. N. Taylor, U.S. Pat. No. 3,042,019.

OBJECTS AND SUMMARY OF THE INVENTION

It is the principle object of the present invention to provide a serving tray that is structurally balanced.

It is a related object of the present invention to provide a balanced serving tray wherein balancing is provided by a two-level tray, a lower storage level being located in positions so as to establish a center of gravity of the tray below an arm support position on the upper level tray, on which upper tray cocktail glasses are supported.

It is another object of the present invention to provide a serving tray having a waste storage receptacle which receptacle can be quickly and easily removed from the tray to dump the waste contents.

It is a related object of the present invention to provide a serving tray having multiple compartments on one of the tray levels for storage of miscellaneous items.

In accordance with the objects of the invention, a serving tray including an upper level tray for carrying drinks and a lower or bottom level tray divided into various storage compartments is provided for use by waitresses. A generally rectangular box portion interconnects the lower tray to the upper tray. The box portion has a hand opening in one side wall thereof which allows the waitress to extend an arm and hand into an interior of the box portion to a position adjacent a bottom surface of the upper tray. The server supports the entire serving tray at the bottom surface, which tray is balanced by the weight of the bottom portion which is located below the center of gravity of the tray.

Around the periphery of the lower tray, a number of storage compartments are formed. Along one side edge of the lower tray, a removable waste storage receptacle is releasable connected. The waste storage receptacle is conveniently located for easy access by the free hand of the user of the tray. The waste storage receptacle mates to the lower tray and has means formed thereon for releasably securing the waste storage receptacle in position on the lower tray.

DESCRIPTION OF THE PREFERRED EMBODIMENT

Figure 1:
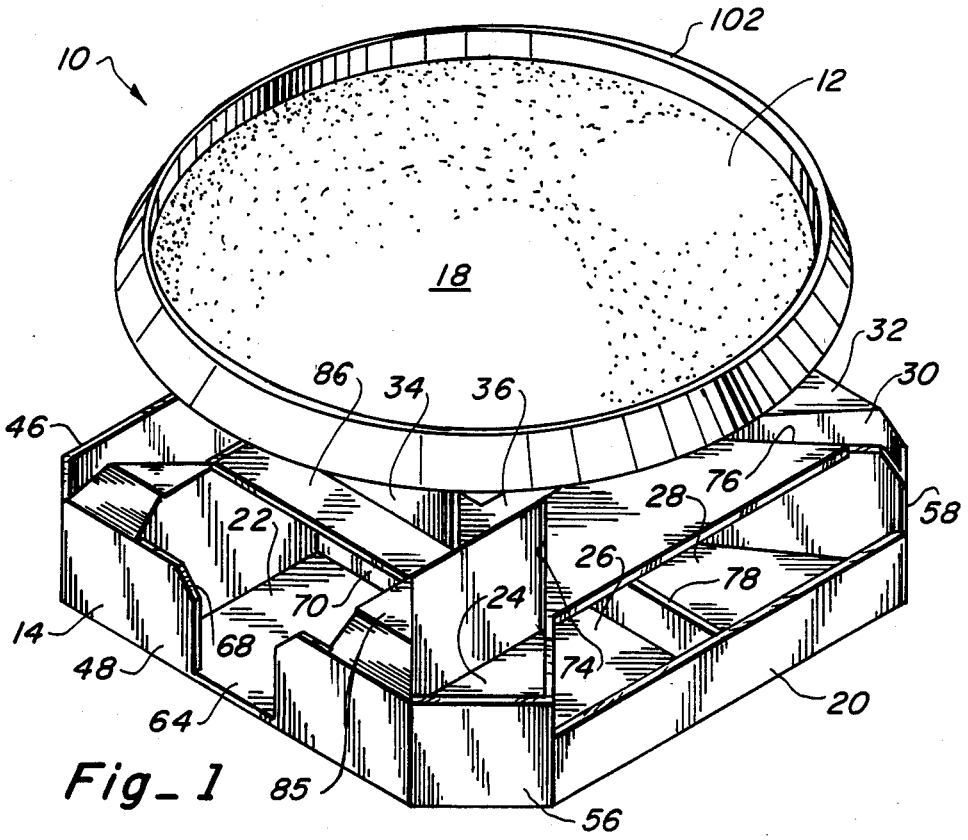
FIG. 1 is a perspective view of a serving tray of the invention.
Figure 3:
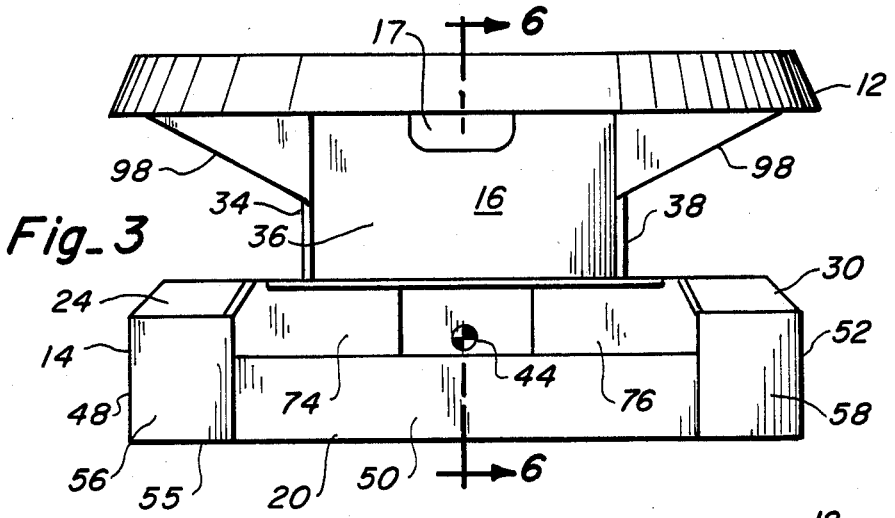
FIG. 3 is a side elevational view of the serving tray shown in FIG. 1.
Figure 4:
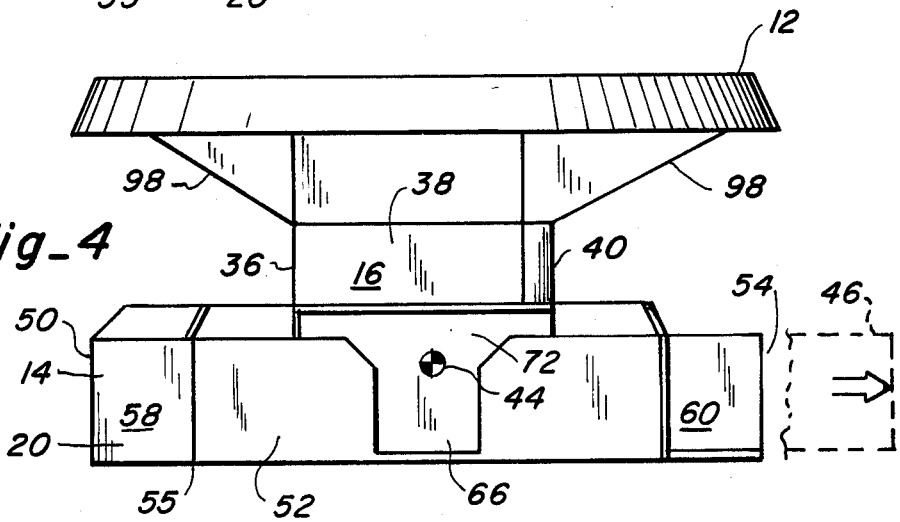
FIG. 4 is a second side elevational view of the serving tray shown in FIG. 1, a removable waste receptacle being shown in phantom line at a removed position.

A cocktail serving tray 10 is seen in the drawing figures to include an upper level tray 12 interconnected by a box structure 16 to a lower level tray 14. The upper tray 12 is essentially of the same configuration as the prior art, including therefore a flat planar surface 18 of circular plane view (FIGS. 1 and 2) for supporting glasses (not shown). The lower tray 14 is of generally square rectangular plane view and has a wall 20 of predetermined thickness or height, which wall 20 is divided into storage compartments 22, 24, 26, 28, 30 and 32. The box structure 16 includes four side walls 34, 36, 38 and 40 (FIGS. 3–5) which lie in planes essentially parallel to the wall 20 of the lower tray 14.

Figure 5:
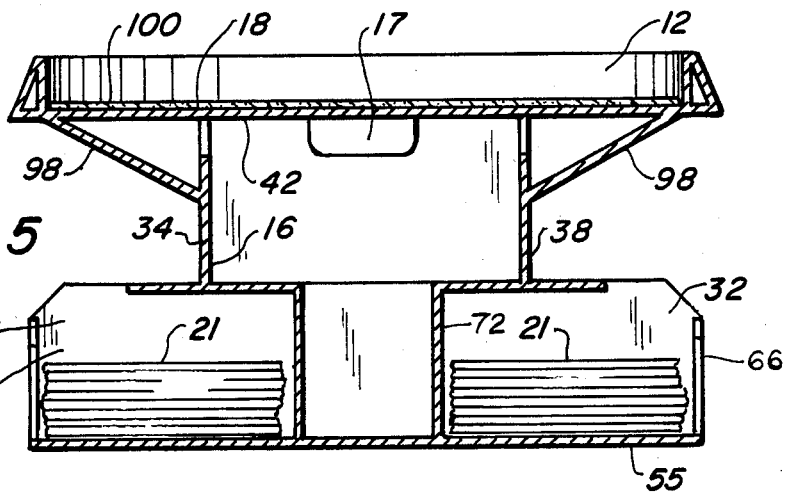
FIG. 5 is a sectional view taken in the plane of line 5—5 of FIG. 2.

The box structure 16 also has formed through each side walls 36 and 40, at a position near the connection to the upper tray 12, a hand opening 17 (FIG. 5). A hand of a cocktail waitress or server is passed through the hand opening 17. The hand supports the tray 10 on a bottom surface 42 of the upper tray 12. The portion of the serving tray 10 including the box structure 16 and the lower tray 14 that is below the position where the hand of the server supports the upper tray 12 is of sufficiently greater weight than the remainder of the serving tray 10 that a center of gravity 44 of the entire serving tray 10 is below the hand of the server. This is a stable position for the center of gravity 44 of the entire serving tray 10 in that the tray 10 always tends to align itself along lines perpendicular to the earth's surface. This perpendicular orientation maintains the upper tray 12 in a level position and makes it less likely for liquid to spill from glasses supported on the upper tray 12.

Figure 7:
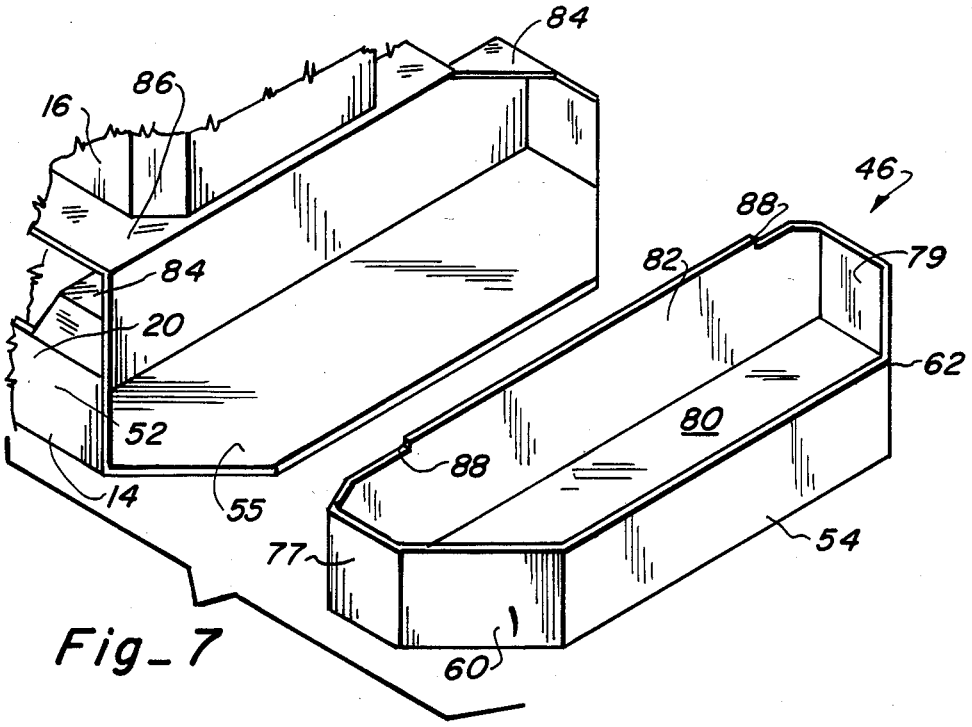
FIG. 7 is a fragmentary perspective view showing the waste storage receptacle in a removed position from a lower tray of the serving tray.

Mounted in the lower tray 14 is a separate removable waste storage receptacle 46 (FIG. 7). The waste receptacle 46 extends along and defines a fourth wall panel 54 of the wall 20 of the lower tray 14. The receptacle 46 is easily slid out of the lower tray 14 for emptying. A first and third wall panels 48 and 52 of the wall 20 define an outer or peripheral border of the lower tray 14 for the two napkin storage compartments 22 and 32 respectively. The second side wall panel 50 borders the compartments 24, 26, 28 and 30, which compartments are for receipt of change, matches, cigarettes, candy, nuts and like articles, not shown.

The lower tray 14 includes the four side walls around the periphery, first side wall 48, second side wall 50, third side wall 52, and fourth side wall 54, which generally define the wall 20 and the shape of the lower tray 14. The lower tray 14 also includes a bottom panel 55 (FIG. 3) defined peripherally by the plan view seen in FIG. 2. Between each pair of adjacent side walls is a corner panel 56, 58, 60 and 62, generally of the same height as the respective side walls, lying along a line defining a 135° angle with each of the side walls between which the respective corner panel is placed. The first corner panel 56 is disposed between the first wall panel 48 and the second wall panel 50. In a like manner, the second corner panel 58 is disposed between the second wall panel 50 and the third wall panel 52, third corner panel 60 between the third wall panel 52 and the fourth wall panel 54, and the fourth corner panel 62 between the fourth wall panel 54 and the first wall panel 48. The resultant outline of the lower tray 14 is seen is FIG. 2 of the drawings.

The first wall panel 48 has a napkin access notch 64 extending the full height thereof. A similar napkin access notch 66 is formed in the third wall panel 52. The napkin compartments 22 and 32 are defined between an inner surface 68 of the first wall panel 48 and the third wall panel 52 and corresponding outer surfaces 70 and 72 of the first side wall 34 and third side wall 38 of the box structure 16.

The miscellaneous storage compartments 24, 26, 28 and 30 are formed between the second wall panel 50, the first corner panel 56, second corner panel 58, the two napkin compartments 22 and 32 and the second side wall 36 of the box structure 16. Divider panels 74 and 76, which are angled with respect to the second wall panel 50, form the two irregularly shaped compartments 24 and 30 adjacent to the first and second corner panels 56 and 58. A third divider 78 perpendicularly intersects and divides the second wall panel 50 into two equal areas for the additional storage compartments 26 and 28.

The fourth wall panel 54, and the third and fourth corner panels 60 and 62 define a portion of the removable waste receptacle 46. (FIG. 7) The removable waste receptacle 46 is formed in part by portions 77 and 79 of the first and third wall panels 48 and 52 and all of the fourth wall panel 54 of the lower tray. A bottom wall 80 of the storage receptacle 46 and a back wall 82 complete the shape of the storage receptacle 46.

Figure 2:
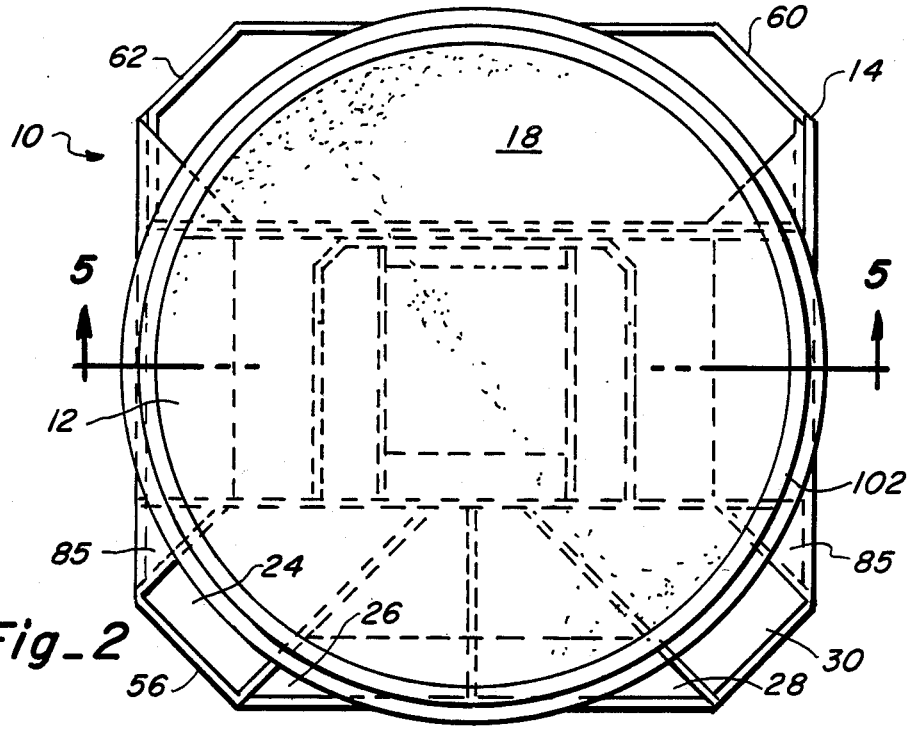
FIG. 2 is a top plan view of the serving tray shown in FIG. 1, portions of the tray being shown in phantom line.

Near the location of the third and fourth corner panels 60 and 62, the lower tray 14 includes two triangular panels 84 integrally connected to the top edge of both the first and third wall panels 48 and 52, generally adjacent to a ledge panel 86 surrounding the box structure 16. (FIG. 7) A second triangular panel 85 interconnects the ledge panel 86 surrounding the box structure 16 and the first wall and third wall, as seen in FIG. 2. Mating notches 88 are formed in the back wall 82 of the storage receptacle 46, which notches 88 are overlaid by the triangular panels 84. The receptacle 46 is further supported in the lower tray 14 by the panel 55. This interconnection between the lower tray 14 and the storage receptacle 46 allows the storage receptacle 46 to be carried around with the tray 10 and then easily removed when it is necessary to dump waste or trash from the receptacle 46.

In addition to the ledge panel 86, the box structure 16 extends centrally through the entire serving tray 10 to connect to the bottom panel 55 of the lower tray 14. (FIG. 5) Projecting above the ledge panel 86, the box structure 16 includes the first side wall 34, the second side wall 36, the third side wall 38, and the fourth side wall 40, all lying in parallel planes to the first, second, third and fourth wall panels 48, 50, 52 and 54 respectively of the lower tray 14. The hand opening 17 is formed through the second and fourth side walls 36 and 40, all as previously described.

Figure 6:
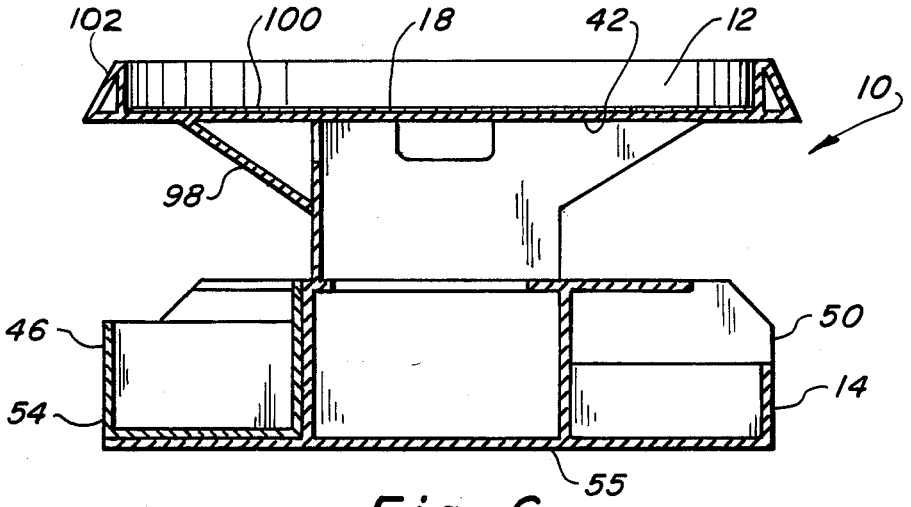
FIG. 6 is a sectional view taken in the plane of line 6—6 of FIG. 3.

Support panels 98 connect to each of the side walls 34, 36, 38 and 40 of the box structure 16, projecting upwardly and away therefrom to connect to a bottom surface of the upper tray 12. (FIGS. 3–5) The upper tray 12 is a circular plane view and includes on a top surface 18 thereof an absorbent cork surface 100 as in conventional cocktail trays. Step 102 is formed around the outer periphery of the upper tray 12 of generally triangular cross section, as seen in FIG. 6.

In using the tray 10, the hand is inserted in the hand opening 17, drinks being placed on the upper tray 12. Miscellaneous articles are placed on the miscellaneous storage compartments 24, 26, 28 and 30 along the second wall panel 50. Napkins 21 are easily available from either side of the tray 10 through the napkin compartments 22 and 32 adjacent the first and third wall panels 48 and 52. Trash is placed in the removable storage receptacle 46.

The center of gravity 44 of the entire tray 10 is lower than the support point of the tray 10. Accordingly, the entire serving tray 10 tends to stay in line with the force of gravity, minimizing the chances of spilling, or dropping anything from the tray 10. The removable storage receptacle 46, see FIG. 6, can easily be dumped without jarring or affecting the serving tray 10.

The entire tray 10 is preferably made of light-weight plastic. It is dimensioned so that the upper tray is essentially the same size as conventional cocktail trays, on the order of fifteen inches.

Although the invention has been described with a certain degree of particularity, nothing contained herein should serve to limit the scope of the invention as defined in the appended claims.

What is claimed is:

1. A serving tray comprising in combination:

an upper tray of generally planar configuration adapted to be supported by a server from a bottom surface of said upper tray;

an interconnecting structure connected to the bottom surface of said upper tray, said interconnecting structure having means for allowing passage of a hand of said server therethrough, said hand to be placed on the bottom surface of said upper tray; and a lower tray connected to said interconnecting structure including a peripheral outer wall, said outer wall defining a perimeter of generally square plan view and including four wall panels, one of said wall panels defined by a removable container selectively connected to said lower tray, at least one of the other of said wall panels having an opening therethrough for access to napkins held within said lower tray, at least one of the other of said wall panels having associated storage receptacles formed in said lower tray, said receptacles having dividers to separate the receptacles into compartments.

2. The invention as defined in claim 1 wherein said interconnecting structure includes walls corresponding to the wall panels and in parallel planes with respect thereto, two of said walls including upperly and outwardly extending support panels connected to said upper tray and two of said walls having a hand opening formed therefor passage of the server's hand through said interconnecting structure to support the upper tray from the bottom surface.

3. The invention as defined in claim 1 wherein the removable container defines one of said wall panels and portions of two adjacent of said wall panels, said removable container further having a rear wall panel and a bottom panel, said rear wall panel having notches formed therein to matingly connect to said serving tray.

* * * * *